US009278383B2

(12) United States Patent
Fischereder et al.

(10) Patent No.: US 9,278,383 B2
(45) Date of Patent: Mar. 8, 2016

(54) BENDING PRESS WITH A WORKPIECE POSITIONING DEVICE AND AN OPERATING METHOD

(75) Inventors: Bernhard Fischereder, Voecklabruck (AT); Thomas Reiter, St. Marienkirchen a.d. Polsenz (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 386 days.

(21) Appl. No.: 13/814,282

(22) PCT Filed: May 2, 2011

(86) PCT No.: PCT/AT2011/000212

§ 371 (c)(1), (2), (4) Date: Feb. 5, 2013

(87) PCT Pub. No.: WO2012/016252

PCT Pub. Date: Feb. 9, 2012

(65) Prior Publication Data

US 2013/0160508 A1 Jun. 27, 2013

(30) Foreign Application Priority Data

Aug. 5, 2010 (AT) ..... A 1315/2010

(51) Int. Cl.
*B21D 5/00* (2006.01)
*B21D 5/02* (2006.01)
(Continued)

(52) U.S. Cl.
CPC ..... *B21D 5/002* (2013.01); *B21D 5/0281* (2013.01); *B21D 43/003* (2013.01); *B21D 43/105* (2013.01); *B21D 43/26* (2013.01)

(58) Field of Classification Search
CPC ..... B65H 5/00; B21D 5/002; B21D 43/003; B21D 5/0281; B21D 43/26; B21D 43/105
USPC ..... 72/20.1–20.3, 21.3, 404, 72/405.01–405.016, 417–422, 428
See application file for complete search history.

(56) References Cited

U.S. PATENT DOCUMENTS 4,078,416 A * 3/1978 Voorhees et al. ..... 72/419
4,414,887 A * 11/1983 Orii ..... 100/45
(Continued)

FOREIGN PATENT DOCUMENTS

AT 402 372 4/1997
AT 503 790 1/2008
(Continued)

OTHER PUBLICATIONS

Wikipedia.com page for "Fiberglass".*
(Continued)

*Primary Examiner* — Shelley Self
*Assistant Examiner* — Patrick Gunson
(74) *Attorney, Agent, or Firm* — Collard & Roe, P.C.

(57) ABSTRACT

The invention describes a bending press and a production device and describes a method of operating such a press, including a workpiece handling device and including a central control device and a workpiece positioning device with a first arresting device and with at least one further arresting device with arresting fingers which are adjustable in an X axial direction extending perpendicular to a bending plane for positioning a workpiece on a first bending tool for a bending operation between the first bending tool and a second bending tool that is adjustable relative thereto. The arresting device has a carriage module and a finger carrier with the arresting finger, and at least one drive means for the adjustment of the arresting finger is formed by a servomotor activated by means of a measuring and controlling circuit of the control device.

11 Claims, 8 Drawing Sheets

(51) Int. Cl.

| | |
|---|---|
| ***B21D 43/00*** | (2006.01) |
| ***B21D 43/10*** | (2006.01) |
| ***B21D 43/26*** | (2006.01) |

(56) References Cited

U.S. PATENT DOCUMENTS

| | | | | |
|---|---|---|---|---|
| 4,621,516 | A * | 11/1986 | Schafer et al. | 72/405.12 |
| 4,706,491 | A | 11/1987 | Sartorio | |
| 5,058,406 | A | 10/1991 | Sartorio et al. | |
| 5,493,964 | A * | 2/1996 | Samejima et al. | 100/231 |
| 5,501,095 | A | 3/1996 | Dilger et al. | |
| 5,761,940 | A | 6/1998 | Moore, Jr. et al. | |
| 6,519,996 | B1 | 2/2003 | Gasparini | |
| 6,938,454 | B2 * | 9/2005 | Strasser et al. | 72/420 |
| 7,210,328 | B2 * | 5/2007 | Strasser | 72/420 |
| 2002/0133926 | A1 | 9/2002 | Kilian et al. | |
| 2008/0047316 | A1 | 2/2008 | Gravier | |
| 2011/0048088 | A1 | 3/2011 | Austaller | |

FOREIGN PATENT DOCUMENTS

| | | | |
|---|---|---|---|
| CN | 1276745 | A | 12/2000 |
| CN | 101048241 | A | 10/2007 |
| DE | 93 15 209 | | 3/1995 |
| EP | 0 650 782 | | 5/1995 |
| EP | 0 738 190 | | 2/2000 |
| EP | 1 210 995 | | 6/2002 |
| GB | 1 544 452 | | 4/1979 |
| GB | 2 249 275 | | 5/1992 |
| WO | 99/20410 | A1 | 4/1999 |
| WO | WO 03/095125 | | 11/2003 |

OTHER PUBLICATIONS

International Search Report of PCT/AT2011/000212 dated Sep. 9, 2011.

* cited by examiner 84
79
62
5
2
15
4
68
85
82
81
70
72
59
46
17
77
12
80
74
77
17
46
59
83
73
69
71
3
31
60
65
24
25
62
56
78
23

84
62
5
4
68
85
81
59
46
17
12
80
74
17
46
59
73
69
3
83
82
24
25
62
56

BENDING PRESS WITH A WORKPIECE POSITIONING DEVICE AND AN OPERATING METHOD

CROSS REFERENCE TO RELATED APPLICATIONS

This application is the National Stage of PCT/AT2011/000212 filed on May 2, 2011, which claims priority under 35 U.S.C. §119 of Austrian Application No. A 1315/2010 filed Aug. 5, 2010, the disclosure of which is incorporated by reference. The international application under PCT article 21(2) was not published in English.

The invention relates to a method of operating a bending press, and a bending press and a production device.

Document EP 0 738 190 A1 discloses a method and a device for feeding sheet-shaped workpieces in an exact position in readiness for undertaking a bending operation between bending tools of a bending press. The workpiece is moved into the working area between the bending tools by means of a gripping device of a handling unit and positioned by reference to a predefined bending line in accordance with measurement data from at least two arresting fingers equipped with measuring sensors by actuating displacing movements of the gripping device of the handling unit accordingly, after which the bending operation is effected by activating the press drive.

AT 402 372 B proposes using a position detecting device for feeding workpieces into a working area between bending tools of a bending press that are displaceable relative to one another by means of a manipulator, by means of which the position of a reference surface of the workpiece is detected with respect to the orientation relative to a bending plane, and in the event of any deviation from a predefined position, a readjustment is made by moving operations of the manipulation unit.

Document U.S. Pat. No. 4,706,491 A discloses a bending press which can be used with a workpiece to carry out a bending operation and a method of positioning the workpiece prior to inserting it between bending tools of the bending press. Based on this design, the bending press has an arresting device on a surface of a press beam facing the manipulator, against which a reference surface of the workpiece is placed by means of the manipulator, thereby detecting a reference position, starting from which the workpiece is positioned by reference to a bending plane in the working area between the bending tools predefined by the bending tools by moving the manipulator.

The objective of the invention is to propose a method of operating a bending press as well as a bending press and a production device having a workpiece positioning device for implementing a manual and automated positioning operation with a view to minimizing non-productive time and ensure a high positioning accuracy and operating safety.

This objective is achieved by the features defined in accordance with the invention. The advantage gained is that the operation of placing the workpiece to be formed on the bending press includes an operation of orienting the workpiece by reference to a bending plane, which might be necessary due to gripping errors, in other words this is run simultaneously, thereby saving on what would otherwise be non-productive time for the position operation.

The practical features defined in claim 2 an embodiment are of advantage in this respect because an exactly defined position reference value is obtained for determining the position of the workpiece, from which steps for correcting the position can be determined and a position signal can be retrieved from the position controller of the X axis, another advantage being the option of storing a threshold value.

The features described in another embodiment are also possible whereby, in conjunction with the position controller of the X axis, an exactly defined position reference value is obtained for determining the position of the workpiece, from which steps can be determined for correcting the position, and a load signal can be called up by measuring a current uptake of the drive of the arresting finger, another advantage being the possibility of storing a threshold value.

Other advantageous features are described in further embodiments, whereby a large number of arresting methods adapted to the respective set-up operation can be obtained, e.g. such as variably configurable speed sequences and/or resistances for a system-specific and workpiece-specific configuration of the arresting operation corresponding to predefined parameters, e.g. such as workpiece mass, geometry, strength, flexural strength, formation of burrs, system coefficient of friction, system vibrations, etc.

Also of advantage is a feature defined in another embodiment, whereby a relative speed between the workpiece and arresting finger which can be controlled on the basis of the workpiece parameters is obtained during the arresting operation, thereby reducing impulse and impact energy and ensuring a soft arresting contact which is not harsh on the workpiece or device and reduces system vibrations.

In this respect, another embodiment has advantageous features because a time-optimized arresting operation is obtained even, in the case of very unstable workpieces with little intrinsic stiffness without impairing positioning accuracy.

Due to the features of another embodiment, a very simple control is obtained for the resistance which has to be set to oppose the positioning operation on the basis of specific workpiece parameters.

Also of advantage, however, are the features of another embodiment, whereby position correcting measures are obtained directly due to the co-operation of the arresting device and a workpiece handling device.

Other possible features defined in further embodiments are also of advantage because the corresponding control characteristics mean that any subsequent vibrations which might have a negative effect on positioning accuracy whilst feeding the workpiece are actively prevented.

Due to the advantageous features defined in other embodiments, the displacement speed and displacement force are limited to an operating force in the direction of movement, thereby resulting in a high degree of operating safety and satisfying critical safety criteria.

However, the objective is also advantageously achieved by a bending press based on the characterizing features defined in accordance with the invention because the positioning element of the arresting fingers essential to achieving an exact positioning of the workpiece has a low mass relative to the arresting device as a whole, as a result of which short positioning times can be achieved made possible by the fact that a high acceleration can be achieved with a low driving force and hence also very refined adjusting operations.

As a result of advantageous embodiments, positioning operations which reduce cycle times are obtained when using several tool sets on a bending press to run a sequence of operations on a workpiece, thereby making operation of the bending press economical.

Based on other advantageous embodiments, technically proven drive arrangements suitable for a long service life are obtained.

Due to the modular design, other advantageous embodiments make for economic mass production of the components that are critical for exactly guiding the arresting devices, which can be fitted on different designs of bending press and simplify use thereof on the bending presses.

However, the embodiments of the arresting finger are also intended for universal use, regardless of the many different types of workpiece geometry, because several different arresting operations are obtained as a result.

Finally, however, the embodiments of the arresting finger, wherein the arresting finger is of a lightweight design, e.g. of lightweight metal, plastic, such as GRP, etc., are also of advantage due to the low weight of the arresting finger which can be obtained and hence an associated low driving power for the drive arrangement whilst ensuring a high actuation speed for time-optimized arresting operations.

However, the objective is also achieved by a production device in accordance with the invention, due to the fact that the bending machines are disposed at a distance apart from one another in alignment with the stationary bench beam and, bridging the distance, mutually opposite arresting track modules are disposed on the bench beam of the bending presses connected via a bridging module to linear guides for the arresting device of the workpiece positioning device. The advantage of this is that the modular design enables production cells adapted to specific requirements to be created due to the possibility of being able to combine different machine types of the bending presses and set them up rationally so as to adapt to production operations which change as a result of the many types of product to be produced, extending the mass production capacity of such a production device, and enabling the use of prefabricated components to link the systems.

In this respect, embodiments are of advantage because the degree of automation of such a production device can be increased for relatively low investment costs.

Finally, however, other embodiments are of advantage because an intrinsically rigid machine frame optimized to suit the respective machine type of the bending press in terms of strength requirements is obtained, thereby satisfying the requirements of high quality forming as far as possible.

To provide a clearer understanding, the invention will be described in more detail below with reference to the appended drawings.

These are highly, schematically simplified diagrams illustrating the following:

FIG. 1 a simplified perspective view of a bending press proposed by the invention;

FIG. 2 a view in elevation of a production device with bending machines linked to a production cell;

FIG. 3 a production device viewed in section along line III-III indicated in FIG. 2;

FIG. 4 is a simplified perspective view of a workpiece positioning device with two arresting devices;

FIG. 5 an arresting device of the workpiece positioning device, viewed partially in section;

FIG. 6 a diagram of a positioning operation with the workpiece positioning device—step 1;

FIG. 7 a diagram of a positioning operation with the workpiece positioning device—step 2;

FIG. 8 a diagram of a positioning operation with the workpiece positioning device—step 3;

FIG. 9 a view of one possible embodiment of the bending press proposed by the invention;

FIG. 10 the bending press viewed in section along line X-X indicated in FIG. 9;

Figure 1:
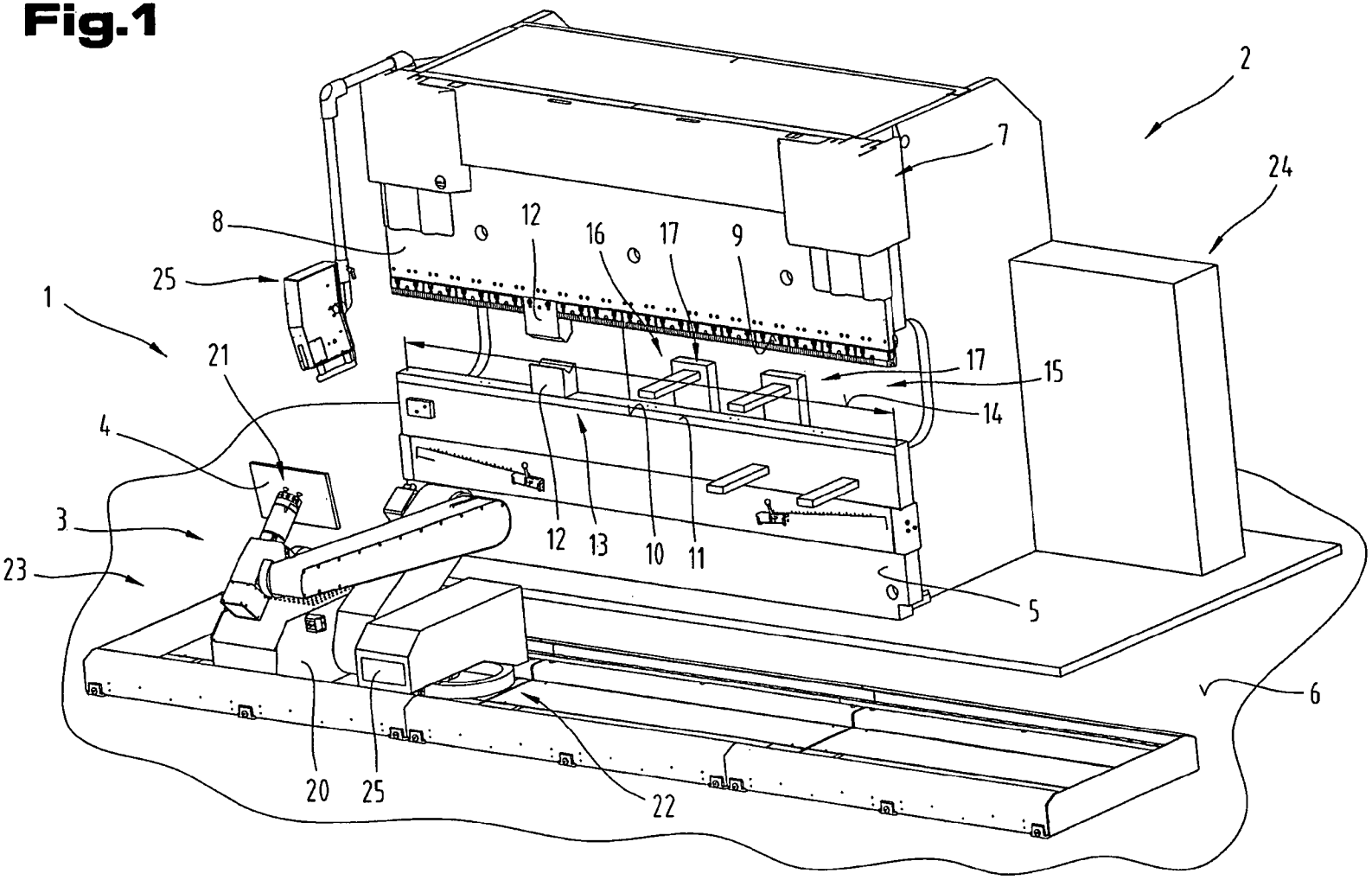

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10

FIG. 1 illustrates a production device 1 comprising at least one bending press 2 and a workpiece handling device 3 for setting up the bending press 2 with a workpiece 4 in readiness for a bending operation.

The bending press 2 has a stationary bench beam 5 disposed in an orientation perpendicular to a standing surface 6 and a press beam 8 which can be displaced relative to it by drive means 7. Disposed on oppositely lying end faces 9, 10 of the bench beam 5 and press beam 8 are tool holders 11 with bending tools 12.

In the embodiment illustrated as an example, a tool set 13 made up of bending tools 12 is provided, and it would also be perfectly possible to provide several of the tool sets 13 across a total length 14 of the bench beam 5 and press beam 8 as tooling equipment, to enable different bending operations to be undertaken on the workpiece 4 in consecutive operations.

Disposed in a press area 15 on a rear face of the bench beam 5 is a workpiece positioning device 16, comprising two arresting devices 17, which will be described in detail below, for positioning the workpiece 4 between the bending tools 12.

In the embodiment illustrated as an example, the workpiece handling device 3 is a multi-axis robot 20, with a gripping device 21 for manipulating the workpiece 4. Manipulation involves picking up from a position of readiness, positioning between the bending tools 12, any side changing which might be necessary and depositing on a product carrier or in a container, etc., once the forming process has been completed.

In order to perform this manipulation, the multi-axis robot 20 is mounted on an undercarriage 22 or provided with an undercarriage 22 and can be moved along a guide arrangement disposed on the standing surface 6, preferably extending parallel with the longitudinal extension of the bench beam 5.

The bending press 2 and workpiece handling device 3 are supplied with power and control signals from a central control device 24, and other measuring and controlling circuits 25 may be provided in the control device 24 or externally on the arresting device 17 and/or workpiece-handling device 3 or integrated in an operator terminal of the bending press 2 with other switch and display elements.

Figure 2:
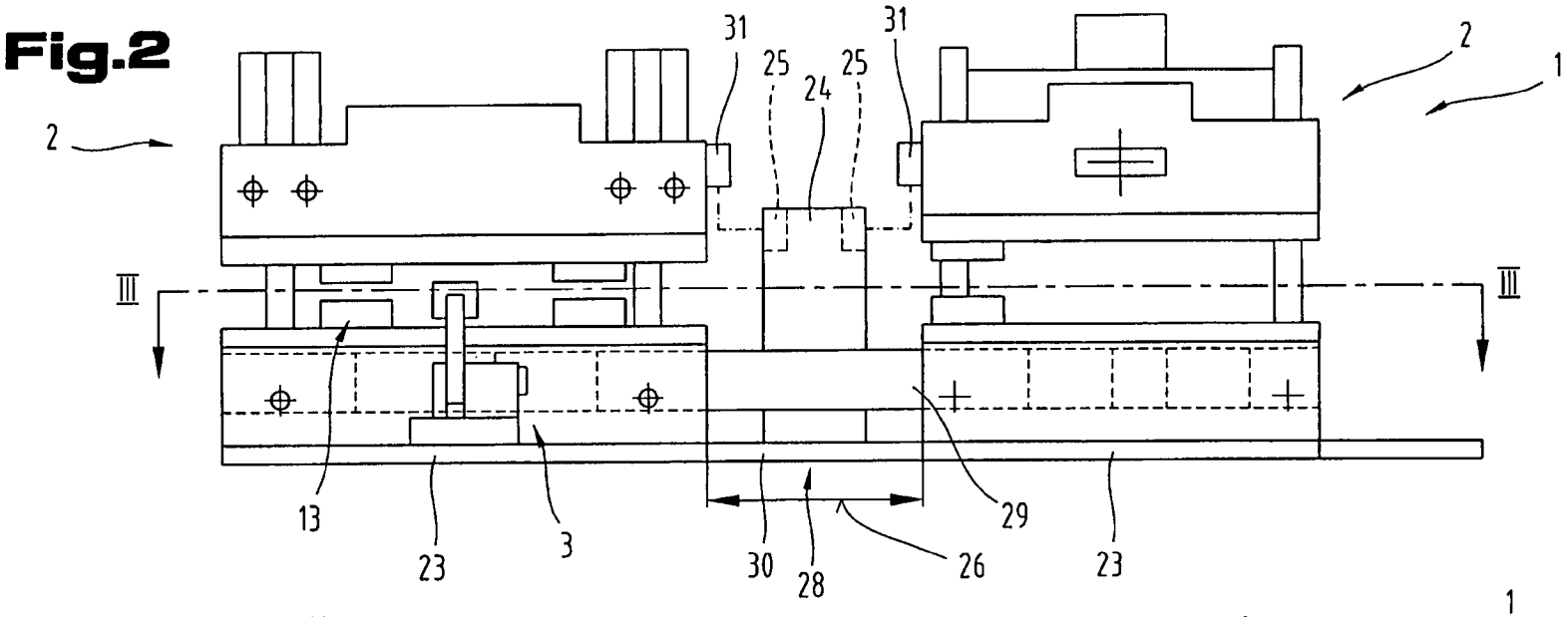
Figure 3:
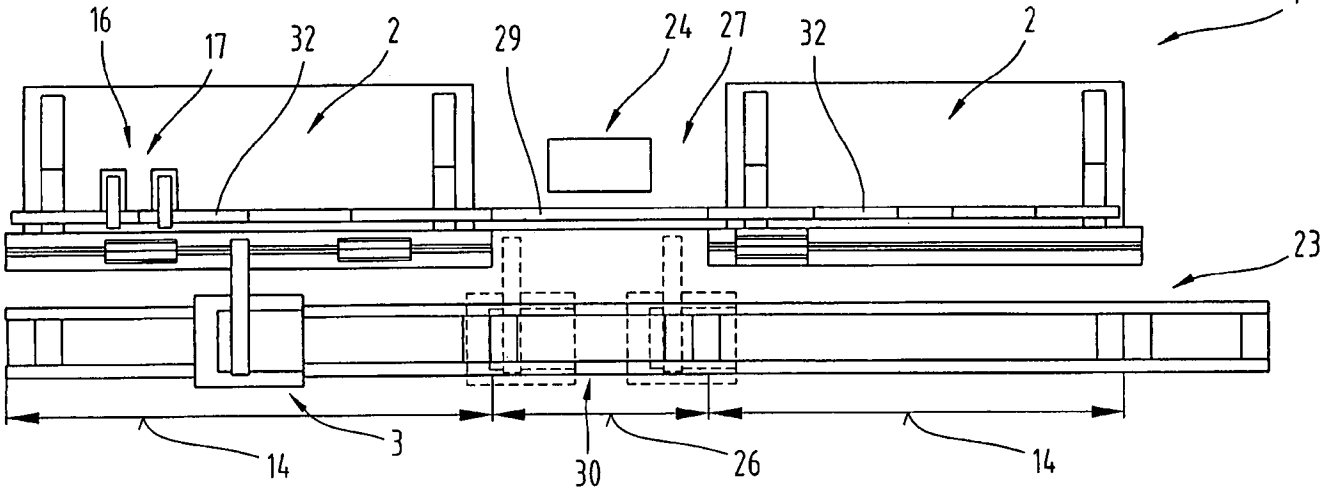

FIGS. 2 and 3 illustrate a linkage of two bending presses 2 to the production device 1, whereby different machine types, e.g. in terms of their pressing force, are combined. Key to such a combination of machines, however, is that specific dimensions which are fixed by construction sizes must match. This results in a multi-space solution for consecutive bending operations, e.g. which require different tool geometry, and these can therefore be run particularly economically.

In the embodiment illustrated as an example, the combined bending presses 2 have a common arresting device 17 which can be positioned relative to the tool sets 13 and a handling device 3 servicing both bending presses 2.

In this respect, it is of advantage to erect the bending presses 2 at a lateral distance 26 from one another, thereby providing a manipulating space 27 for the handling device 3 between the bending presses 2 for an inserting operation, holding and turning operation of the workpiece 4.

Such a combination of the bending presses 2 is made possible by linking modules 28, in particular a guide track module 29 for the arresting device 17 and a guide track module 30 for the guide arrangement 23 of the workpiece handling device 3, for respectively bridging the distance 26 between the bending presses 2.

Furthermore, the control device 24 is designed to co-operate with the de-centrally disposed measuring and controlling circuits 25 of the bending presses 2 and/or workpiece handling device 3 across a plurality of input and output interfaces 31 connected in parallel from the outset and hence for connecting a plurality of measuring and controlling circuits 25. This means that the control device 24 can be used universally depending on the individual components of the production device 1 to be operated.

Figure 4:
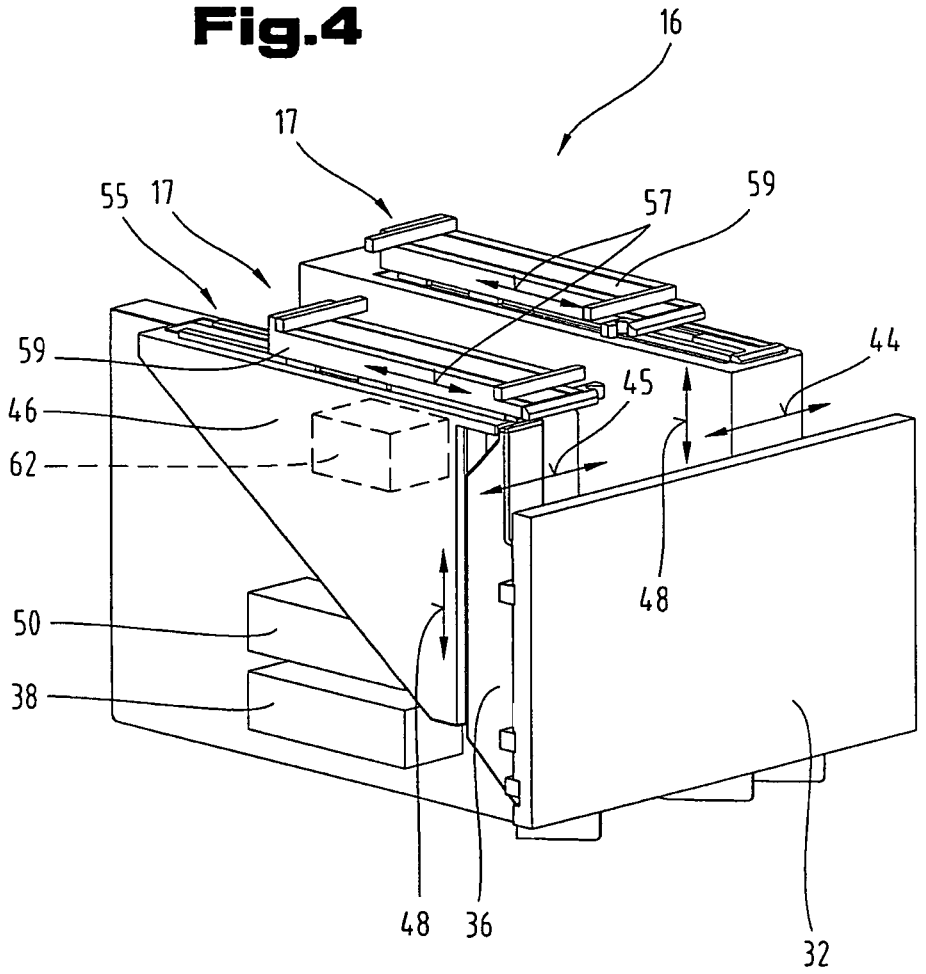
Figure 5:
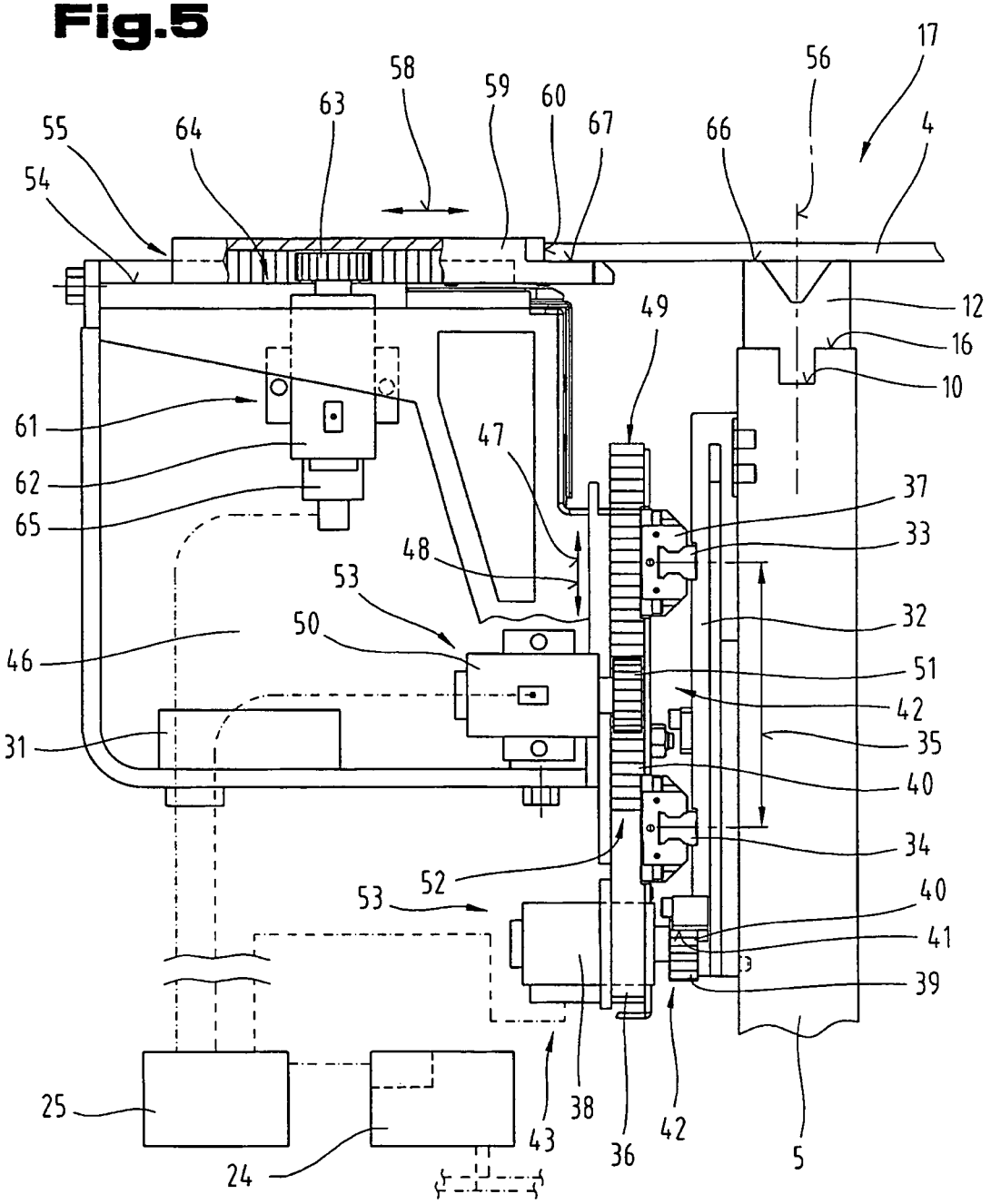

FIGS. 4 and 5 provide detailed illustrations of the arresting device 17 of the workpiece positioning device 16.

Secured to the rear face of the bench beam 5 in an exactly predefined position relative to the end face 10 of the bench beam 5 are preferably several arresting track modules 32, aligned flush with one another in its longitudinal direction. The arresting track module 32 has two linear guides 33, 34, which extend at a distance 35 from one another and are oriented with the arresting track module 32 parallel with the end face 10.

In the embodiment illustrated as an example, the linear guides 33, 34 are provided in the form of strip-shaped guide profiles, for which purpose it is possible to use a large number of guide profiles known from the prior art, the design not being restricted to the slideway guides illustrated in this example of an embodiment.

These linear guides 33, 34 are mounted on a carriage module 36 so as to be displaceable via guide elements 37 provided thereon and co-operating with the linear guides 33, 34.

The carriage module 36 is displaced along the linear guides 33, 34 by means of an electric drive means 38 disposed on the carriage module 36, which is provided with a pinion 39 meshing with a rack 40 on a bottom face 41 of the arresting track module 32, forming a rack gearing 42 serving as a drive arrangement 43 for displacing the arresting device 17 in a Z axial direction 44—indicated by double arrow 45. The electric drive means 38 is preferably a servomotor and the drive arrangement 43 and controller are designed as an NC positioning axis.

A finger carrier 46 is mounted on the carriage module 36 so as to be displaceable in an R axial direction 47—indicated by double arrow 48—extending perpendicular to the Z axial direction 44 in a linear guide track 49.

To this end, the finger carrier 46 has another electric drive means 50 disposed thereon, which is drivingly connected to a pinion 51 with a linear tooth design 52 on the carriage module 36, thereby forming another drive arrangement 53 of the arresting device 17. The electric drive means 50 is preferably a servomotor and the drive arrangement 53 and controller are designed as an NC positioning axis.

On a top face 54, the finger carrier 46 provides a mount for an arresting finger displaceable in a linear guide track 55 in an X axial direction 57—indicated by double arrow 58—extending perpendicular to a bending plane 56 and this arresting finger 59 constitutes at least one arresting surface 60 facing the bending plane 56 for positioning the workpiece 4 relative to the bending plane 56.

A drive arrangement 61 for the arresting finger 59 is provided in the form of an electric drive means 62 disposed on the finger carrier 46, which is drivingly connected to a pinion 63 with a linearly extending tooth design 64 of the arresting finger 59 and the electric drive means 62 is preferably a servomotor with a rotary transducer 65, thereby setting up an NC actuator for displacing the arresting finger 59 in the X axial direction 57.

The drive means 38, 50, 62 are connected via cables to the input and output interface 31.

As may also be seen from FIGS. 4 and 5, two arresting devices 17 of the same type and independent of one another which are displaceable both in the Z axial direction 44, the R axial direction 47 and the X axial direction 58—as indicated by double arrows 45, 48, 59—are used to position the workpiece 4, for example, and for orienting the workpiece 4 exactly relative to the bending plane 56, which are activated for an operation of positioning the workpiece 4 on the bending tool 12 by the central control device 24 and measuring and controlling circuit 25 co-operating with each arresting device 17 in a manner that will be described in detail below.

The drive arrangements 43, 53 and 61 for the positioning operations of the arresting devices 17 in the R, X and Z axial directions are based on an NC-controlled design, as a result of which every axis necessary can be exactly positioned and every position and/or change of position for subsequent control and regulating steps can be exactly detected.

Based on the embodiment illustrated as an example, the bending tool 12 serves as a support plane 66 for the direct bending region of a workpiece 4 during a forming operation. As may also be seen, the arresting finger 59 is of a stepped design in its region facing the bending tool 12, e.g. with two arresting surfaces 60 in the direction of displacement of the arresting finger 59.

In the case of thin workpieces, the stepped design offers the possibility of laying the free end region of the workpiece 4 projecting beyond the bending tool 12 on a support surface 67 of the arresting finger 59 moved into an orientation aligned with the support plane 66.

Figure 6:
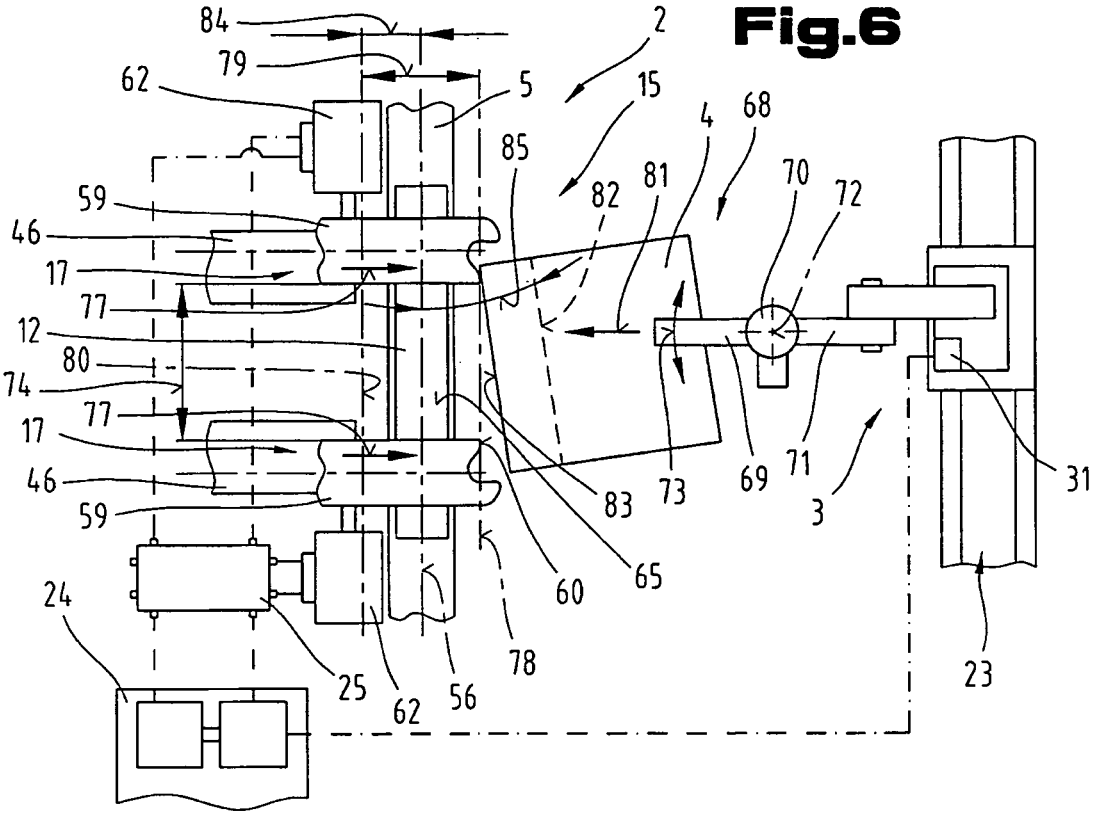
Figure 7:
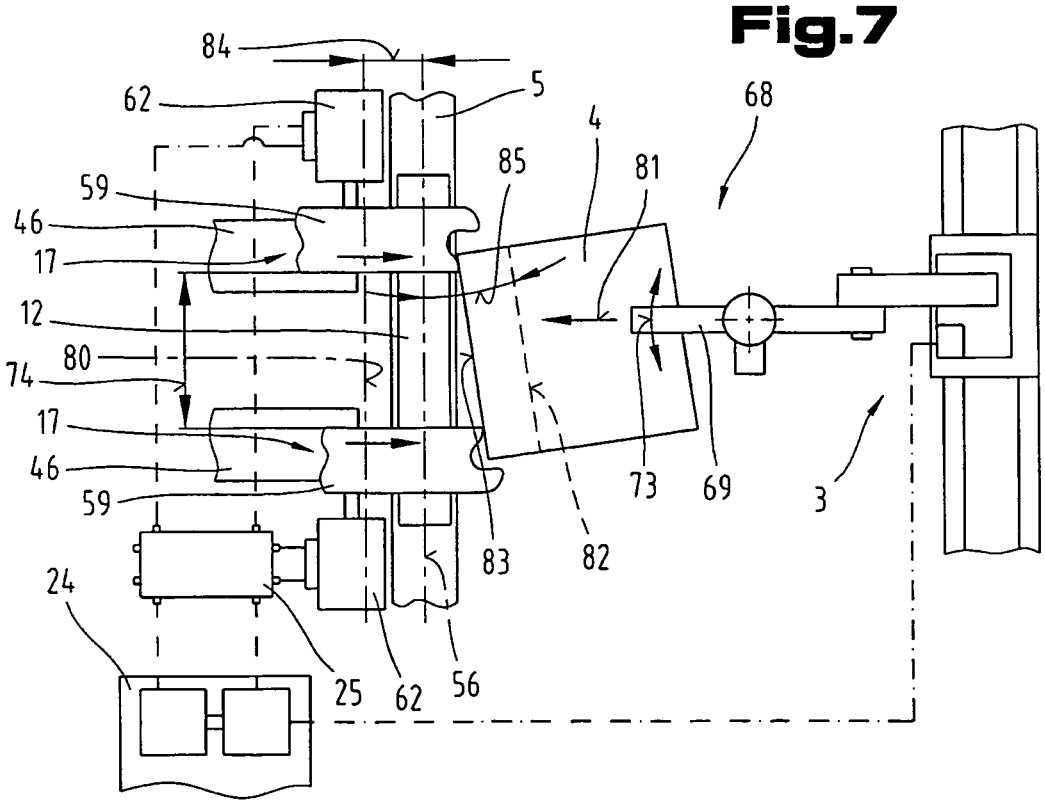
Figure 8:
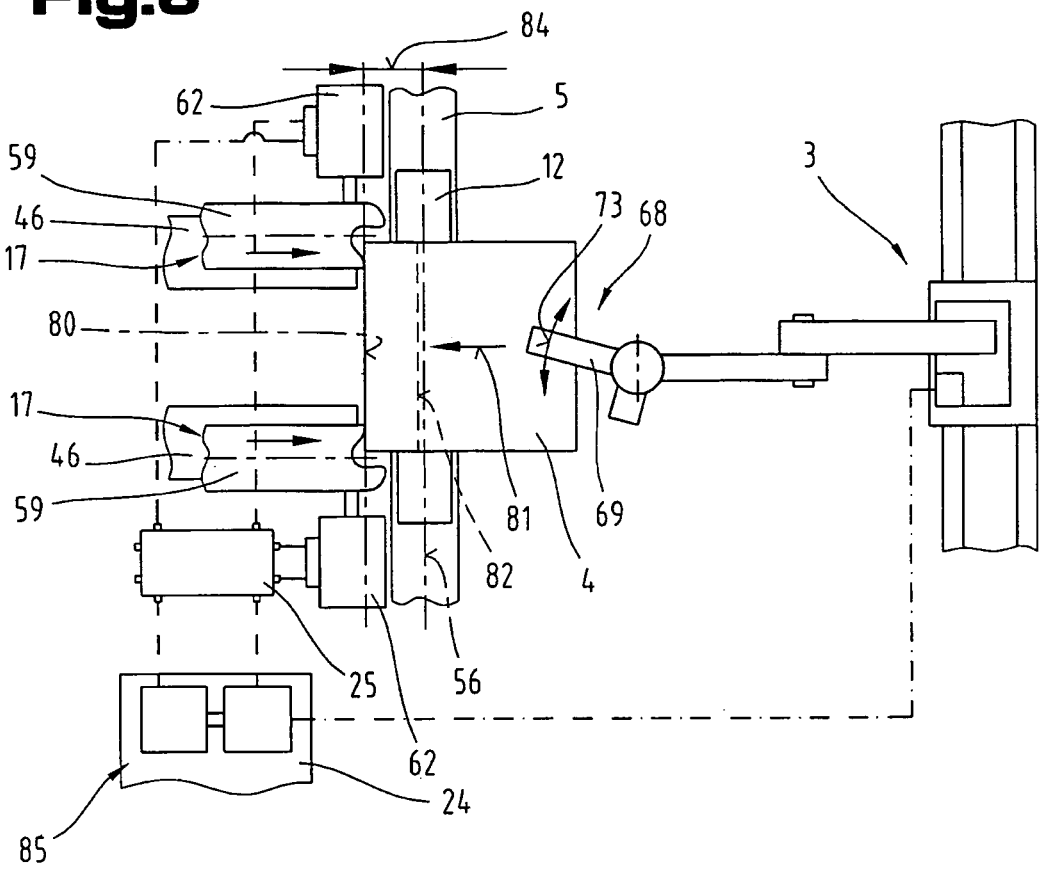

FIGS. 6 to 8 illustrate the operation of positioning the workpiece 4 in the X axial direction, having already positioned the arresting finger 59 in the R and Z axial directions on a bending tool 12 in readiness for running a bending operation, for example in three consecutive steps, and the method of positioning the workpiece 4 will now be described in detail with reference to FIGS. 6 to 8.

Following a start command and having retrieved a program from a program memory of the central control device 24, the workpiece 4 is picked up from a readiness position, not illustrated, by a gripping device 68, for example a pince gripper 69, suction gripper, magnetic gripper, etc., of the handling device 3 and moved by appropriate motion sequences into the direct working area of the bending press 2. The gripping device 68, for example the pince gripper 69, can be pivoted about a pivot axis 72—indicated by double arrow 73—via a rotating unit 70 in an end region of an arm 71 of the handling device 3.

Even as the workpiece 4 is being picked up by the gripping device 69 and moved 4 into the press area 15 of the bending press 2, the arresting finger 59 is positioned in the R, X and Z axial directions in accordance with the predefined work program and in accordance with the stored geometric data pertaining to the workpiece 4, and positioning operations are preferably run simultaneously.

Positioning operation Z axial direction: This involves a positioning operation of the arresting devices 17 relative to one another in the Z axial direction—the latter being positioned at a distance 74 as a function of the workpiece geometry and corresponding to the position of the bending tools on the bench and press beams.

Positioning operation R axial direction: Taking place simultaneously with the positioning operation in the X axial direction is a positioning operation of the finger carrier 46 with the arresting fingers 59 in the R axial direction—whereby the arresting fingers 59 are positioned in terms of their vertical height relative to the support plane 66 as a function of a bending tool height.

Positioning operation X axial direction: Taking place simultaneously with the above-mentioned positioning operations, the arresting finger 57 is displaced in the X axial direction—indicated by arrows 77—into a stop-start position 78 under the control of the program. During this motion sequence of the arresting finger 59, the drive means 62 is regulated in terms of speed and power, in particular depending on how close the arresting finger 59 is to the stop-start position 78, and the other motion sequences of the arresting device 17 and arresting finger 59 are preferably run at full power and the highest possible speeds.

This is done by regulating the rotation speed of the drive means 62 of the arresting finger 59 and regulating the motor torque, for example by the de-centrally disposed measuring and controlling circuit 25 by regulating the motor current of the drive means 62, for example. In other words, it is preferable to regulate both the speed at which the arresting finger 57 is moved towards the stop-start position 78 and the driving force which, for safety reasons, should not exceed 150 N, from a distance of less than about 50 mm in the end region of the approach to the stop-start position 78

It should also be pointed out that the force limiter is preferably not activated by the motor current controller except when approaching the stop-start position 78 and the rest of the motion sequences are run at high positioning speeds, in other words at full load, in order to reduce non-productive time.

The advantage of the structural design of the arresting device 17 is that a low mass of the arresting finger 59 is moved compared with conventional arresting devices which generally have relatively high moved masses. Accordingly, the arresting fingers 59, which are driven directly, are preferably made from lightweight materials such as aluminum, plastic, such as GRP, etc.

The stop-start position 78 is disposed upstream of a predefined stop-end position 80 opposite the direction in which the workpiece 4 is fed—indicated by arrow 81—by a predefined, selectable distance 79.

The stop-end position 80 is derived from the position of a bending line 82 relative to a workpiece support surface 83 and hence a corresponding distance 84 to the bending plane 56.

As may be seen from FIG. 6, for a first step of the positioning operation and illustrated in an exaggerated manner, the workpiece 4 is picked up by the gripping device 68 in a pick-up position in which the workpiece support surface 83 is not oriented parallel with the bending plane 56, i.e. the specified bending line 82 extends at an angle 85 with respect to the bending plane 56 and this angular deviation must be corrected before the bending operation in order to ensure an exact bending operation, which should take place parallel with the support surface 83, for example.

This is done during the subsequent positioning operation, whereby, in order to run an automated operation with the workpiece 4 by the workpiece handling device 3 so that the workpiece support surface 83 is moved into abutment with the arresting surfaces 60 of the arresting finger 59, the workpiece handling device 3 is moved in the direction of the arresting devices 17 and in the direction of the stop-end position 80—indicated by arrow 81.

The arresting fingers 59 afford a resistance to this displacing movement, which can be preselected and regulated as a function of system and workpiece parameters, achieved by activating the power of the drive means 62 accordingly, preferably on the basis of a regulation of the motor current by the measuring and controlling circuit 25.

This results in a position control with underlying force control with virtually any regulation of the resistance to displacement. When setting a resistance to be predefined, allowance is made, in addition to workpiece parameters, for system parameters, due to the fact that the system parameters, in particular the power requirement necessary to displace the arresting fingers and the internal frictional forces, are taken into account, being determined by calibration and set-up operations. Taking account of a basic power requirement determined in this manner means that the resistance which the arresting finger 59 should expend against a displacement into the stop-end position 80 can be regulated very sensitively, depending on the workpiece parameters, between a "soft" and "hard" stop dynamic, up to as dwell function corresponding to a fixed stopping action in the stop-end position 80.

With regard to the regulating operation, it should be explained that the two arresting fingers 59 remain in the stop-start position 78 as the set-point position on the basis of a position control. Due to the underlying force control, a predetermined, freely configurable force opposes a displacement in the direction of the stop-end position 80 due to the workpiece 4 moved by the workpiece handling device 3, which may be an active friction compensation that is lower than the static friction of the arresting finger 59 displaceable in the X axial direction. The opposing force is advantageously higher than the static friction of the workpiece when placed on the arresting finger 59.

During the subsequent positioning of the workpiece 4, the arresting finger 59, supplied with power, is pushed from the start position 78=set-point position into a pre-definable actual position above a threshold value, causing a stop-impulse signal to be generated.

Irrespective of the above, the subsequent positioning of the workpiece 4 continues in the direction of the stop-end position 80 until the above-mentioned operation has been completed on the other arresting finger 59 and a stop-impulse signal has likewise been generated.

The signals generated and the sequence of the signals prompt a cyclically run regulating operation and path regulating operation of the workpiece handling device 3 and gripping device 68 conforming to a predefined control algorithm in order to correct an angle 85 which might exist with respect to the stop-end position 80 due to an incorrect position of the workpiece 4 until this position is reached—as illustrated in FIG. 8, and geometric information pertaining to the workpiece, arresting finger, gripping position, etc., represent other parameters used for the path regulating operation.

The synchronous running of the arresting operation and position correction in the event of any variances guarantees a very rapid positioning operation and thus shortens the overall running time of the bending operation and also offers a high degree of safety during operation.

A variant of the positioning operation described above using the stop-impulse signals generated by the Yes/No contacts of the workpiece 4 on the arresting fingers 59 is one where the stop-impulse signals are load signals generated due to a change in power detected on the basis of a motor current measurement of the drive means 62 of the first and second arresting device 17—after which the stop-impulse signals are converted into the position correction of the workpiece 4 in the manner already described above.

Due to the sensitive regulation of the driving power and hence resistance of the drive arrangements of the arresting fingers to movement which can be achieved, the most important system and workpiece parameters such as workpiece mass, strength, flexural strength, system friction, workpiece static friction, etc., can be taken into account during the operation of positioning the workpiece 4, and system vibrations of the two arresting devices 17 as well as the workpiece handling device 3 during the positioning operation which could give rise to errors are taken into account and prevented.

Taking account of the workpiece parameters in particular also makes a so-called on-the-fly arresting operation possible, whereby the arresting fingers 59 are actively displaced in the direction of the stop-end position 80 by the drive means 62 whilst the workpiece is being fed by the workpiece handling device 3, and a displacement speed of the arresting fingers 59 is selected so that it is lower than the feeding speed of the workpiece, thereby keeping impulse or impact energy low.

This prevents a "hard" impact and crucially prevents the occurrence of system vibrations, which is of advantage for both thin but not very intrinsically stiff workpieces 4 but also those with a high mass.

The description given above using the two arresting devices 17 relates to an operation involving the positioning of the workpiece by the workpiece handling device 3 in the X axial direction with a control to correct an incorrect position relative to the defined bending line 82.

However, it should be pointed out that the arresting device 17 and drive means 38, 50, 62 are or can be controlled for all axial directions—preferably the X and Z axial directions—on the basis of speed and/or torque in accordance with the criteria described above.

Accordingly, the essential criteria for regulating the drive means 38, 50, 62 and the resultant advantages of speeding up the positioning operation, taking account of the system and workpiece parameters, increasing operating safety, amongst others, apply in the same way when it comes to these axes as well as a 1-dimensional positioning operation of the workpiece 4 if using only one of the arresting devices 17.

Figure 10:
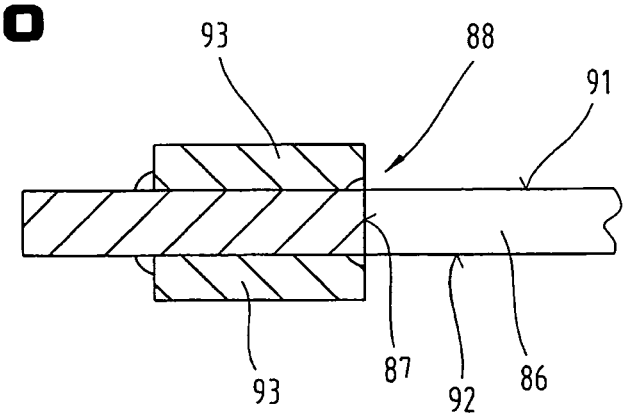
Figure 9:
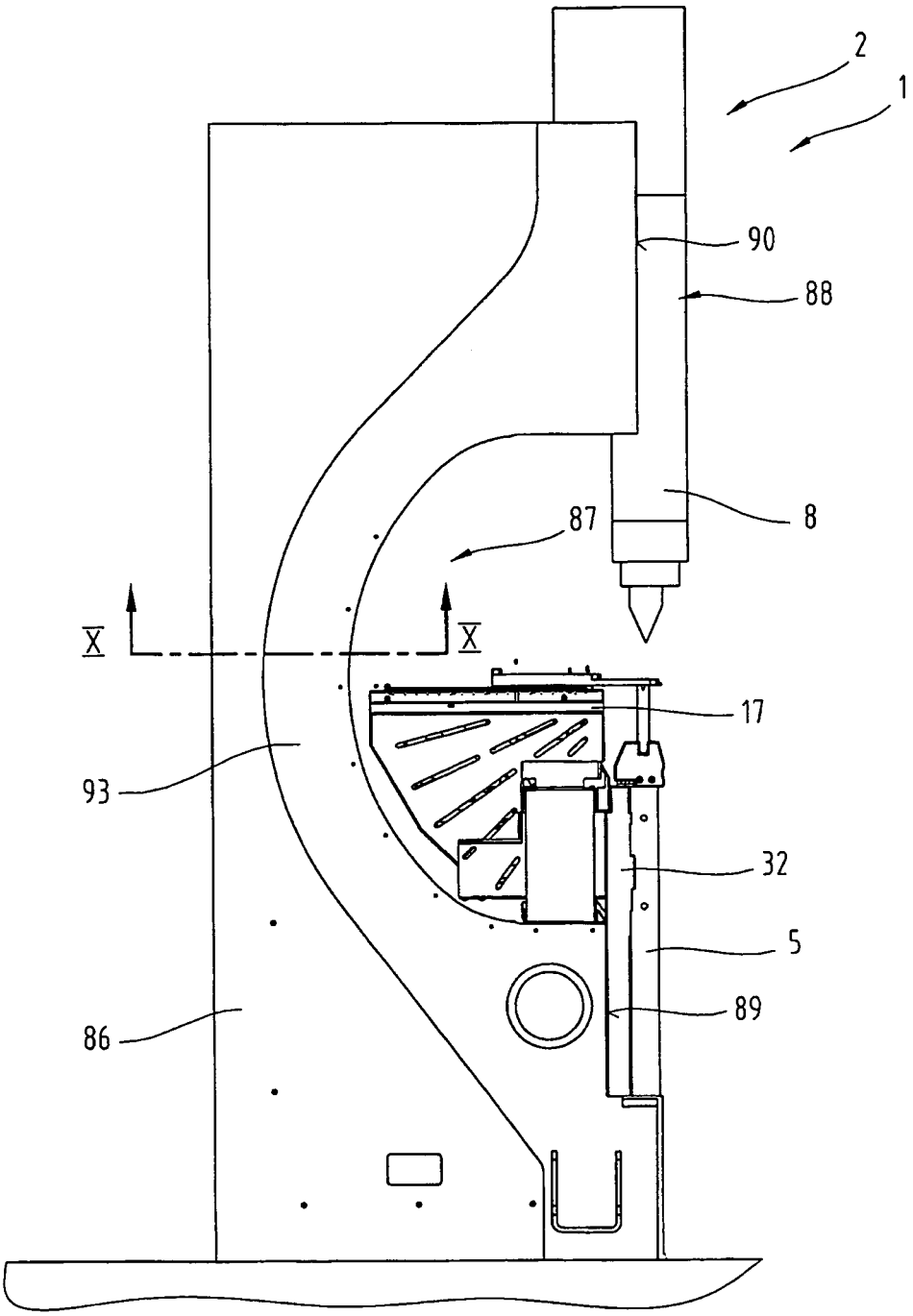

FIGS. 9 and 10 illustrate another embodiment of the bending press 2, specifically designed for linking to a production device 1 comprising several bending presses 2 and where a space for movement is created due to a specially adapted C-shape of side panels 86 to enable the arresting device 17 to be moved between the adjacently disposed bending presses. As already described in connection with FIGS. 2 and 3, such a grouping comprises a combination of arresting track modules 32 and bridging modules disposed in a gap between adjacent bending presses 2, as described above.

In order to create this space for movement of the arresting device 17, a cut-out 87 is provided in a front face 88 of the side panel 86 which is adapted to the external contour of the arresting device 17. This cut-out 87 has an approximately semi-elliptical curved contour between a planar end face 89 in the region of the bench beam 5 and a planar end face 90 in the region of the press beam 8.

In order to increase the resistance of the side panels 86 to deformation and minimize springing under load, reinforcing plates 93 are positively mounted on side faces 91, 92 of the side panels 86 extending along the cut-out 87, e.g. screwed or welded.

Figure 11:
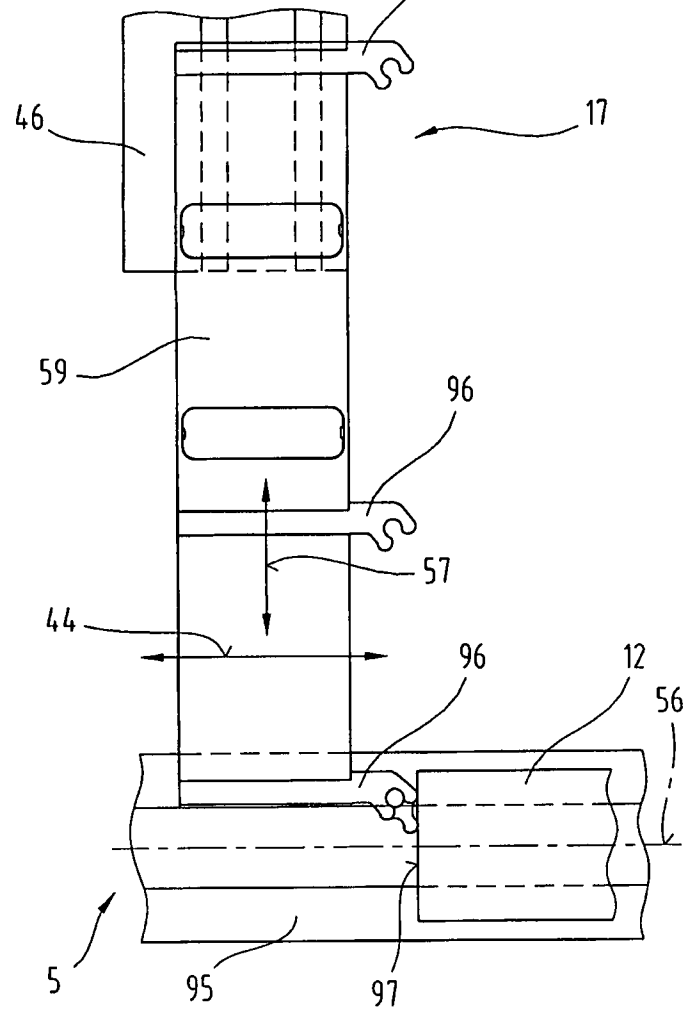
FIG. 11 is a simplified diagram showing another embodiment of the arresting device of the bending press proposed by the invention and the positioning of a bending tool therewith.

FIG. 11 shows a simplified diagram of the arresting device 17 with the finger carrier 46 and arresting finger 59. As described above, the finger carrier 46 is displaceable relative to the bench beam 5 in the R axial direction 47 and Z axial direction 44 and the arresting finger 59 is displaceable relative to the finger carrier 46 and perpendicular to the bending plane 56. Aspects of FIG. 11 that have already been described, such as the guide and drive arrangements, will not be described again here.

FIG. 11 illustrates in detail the way in which the position of the bending tool 12 is detected in a holder device 95, mounted on the bench beam 5, and fixing devices for the bending tools 12, although these are not illustrated.

In accordance with an equipment mounting diagram for a specific forming operation on a workpiece, it is necessary, in addition to fitting the requisite bending tools 12 and setting their position in the tool holder, to move the bending tool 12 or a tool set is into the holder device, either manually or by means of the handling device and, as illustrated in FIG. 11 for example, the positioning operation is run by means of the arresting device 17, during which the arresting finger 59 moved into position with a stop element 96 predetermines the position of, for example, a reference surface 97 of the bending tool 12. After this positioning operation, the bending tool is secured in the holder device. It should also be pointed out that the same operation is naturally also performed for the positioning operation of the bending tool or tool set in a holder device of the displaceable press beam, thereby ensuring an exact match of the position of the co-operating bending tools during the forming operation. This position setting and position determining operation also determines the reference value for activating the handling device for feeding the workpiece into the forming position between the bending tools.

Figure 12:
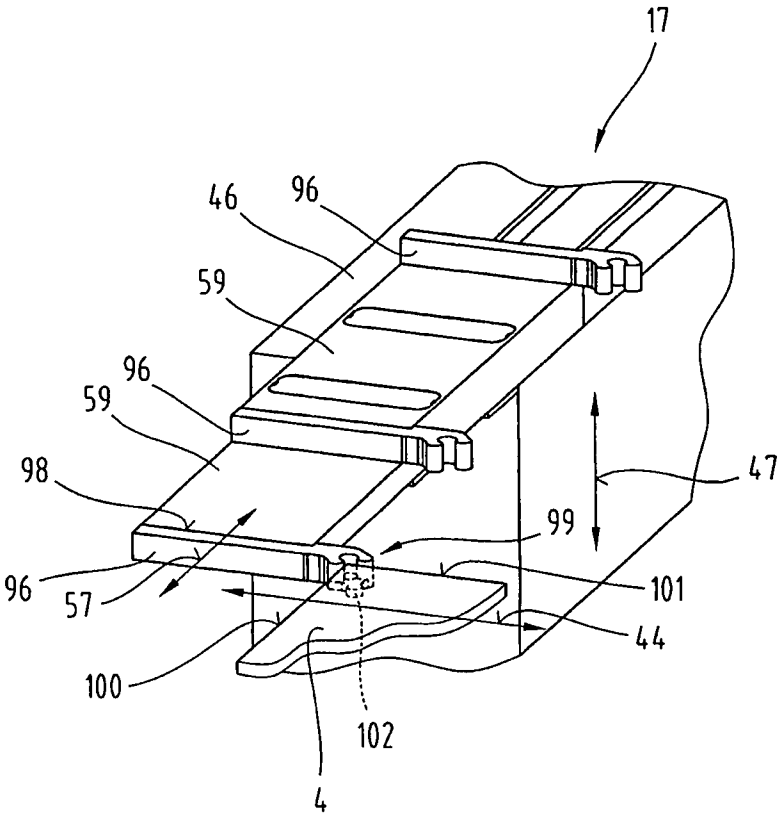
FIG. 12 is a simplified perspective diagram showing another embodiment of the arresting device of the bending press proposed by the invention for the operation of arresting a workpiece.

FIG. 12 provides a detailed illustration of the design of the arresting device 17 with one possible embodiment of the arresting finger 59 on the finger carrier 46 displaceable in the X axial direction 57. As already described above, the finger carrier 46 is displaceable in the R axial direction 47 and Z axial direction 44 and details such as the guide and drive arrangements, etc., already described above will not be described again here.

The arresting finger 59 is preferably provided with several, and in the embodiment illustrated as an example three, of the stop elements 96, which essentially form three arresting planes due to the stepped design of the arresting finger 59 for the workpiece 4.

This makes it possible to provide the support surface 66 already described above for a thin, intrinsically not very rigid workpiece 4 by placing it on one of the top faces 98 of the stop elements 96 of the arresting plane lying underneath during the arresting operation.

The design of the arresting end regions 99 of the stop elements 96 is based on a spherical shape with a gap for the corner region of the workpiece 4, thereby resulting in a linear-shaped contact for the workpiece 4 in two reference planes 100, 101 oriented at a right angle to one another.

As may also be seen, the spherically shaped arresting end region 99 of the stop element 96 of the lowermost arresting plane in the release position has a supporting lug 102 for supporting the workpiece 4 during the arresting operation, which is of advantage in the case of a thin workpiece 4 with little intrinsic rigidity.

The embodiments illustrated as examples represent possible variants of the bending press and a production device, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the bending press and production device, they and their constituent parts are illustrated to a certain extent out of scale and/or on an enlarged scale and/or on a reduced scale.

The objective underlying the independent inventive solutions may be found in the description.

| List of reference numbers | |
|---|---|
| 1 | Production device |
| 2 | Bending press |
| 3 | Workpiece handling device |
| 4 | Workpiece |
| 5 | Bench beam |
| 6 | Standing surface |
| 7 | Drive means |
| 8 | Press beam |
| 9 | End face |
| 10 | End face |
| 11 | Tool holder |
| 12 | Bending tool |
| 13 | Tool set |
| 14 | Total length |
| 15 | Press area |
| 16 | Workpiece positioning device |
| 17 | Arresting device |
| 18 | |
| 19 | |
| 20 | Multi-axis robot |
| 21 | Gripping device |
| 22 | Undercarriage |
| 23 | Guide arrangement |
| 24 | Control system |
| 25 | Measuring and controlling circuit |
| 26 | Distance |
| 27 | Manipulating space |
| 28 | Linking module |
| 29 | Bridging module |
| 30 | Bridging module |
| 31 | Input and output interface |
| 32 | Arresting track module |
| 33 | Linear guide |
| 34 | Linear guide |
| 35 | Distance |
| 36 | Carriage module |
| 37 | Guide element |
| 38 | Drive means |
| 39 | Pinion |
| 40 | Rack |
| 41 | Bottom face |
| 42 | Rack gearing |
| 43 | Drive arrangement |
| 44 | Z axial direction |
| 45 | Double arrow |

-continued

| List of reference numbers | |
|---|---|
| 46 | Finger carrier |
| 47 | R axial direction |
| 48 | Double arrow |
| 49 | Guide track |
| 50 | Drive means |
| 51 | Pinion |
| 52 | Tooth design |
| 53 | Drive arrangement |
| 54 | Top face |
| 55 | Guide track |
| 56 | Bending plane |
| 57 | X axial direction |
| 58 | Double arrow |
| 59 | Arresting finger |
| 60 | Arresting surface |
| 61 | Drive arrangement |
| 62 | Drive means |
| 63 | Pinion |
| 64 | Tooth design |
| 65 | Rotary transducer |
| 66 | Support plane |
| 67 | Support surface |
| 68 | Gripping device |
| 69 | Pince gripper |
| 70 | Rotating unit |
| 71 | Arm |
| 72 | Pivot axis |
| 73 | Double arrow |
| 74 | Distance |
| 75 | |
| 76 | |
| 77 | Arrow |
| 78 | Stop-start position |
| 79 | Distance |
| 80 | Stop-end position |
| 81 | Arrow |
| 82 | Bending line |
| 83 | Workpiece support surface |
| 84 | Distance |
| 85 | Angle |
| 86 | Side panel |
| 87 | Cut-out |
| 88 | Front face |
| 89 | End face |
| 90 | End face |
| 91 | Side face |
| 92 | Side face |
| 93 | Reinforcing plate |
| 94 | |
| 95 | Holder device |
| 96 | Stop element |
| 97 | Reference surface |
| 98 | Top face |
| 99 | Arresting end region |
| 100 | Reference plane |
| 101 | Reference plane |
| 102 | Supporting lug |

The invention claimed is:

1. A method of operating a production device comprising at least one bending press and a workpiece handling device and having a central control device and a workpiece positioning device with a first arresting device and at least one other arresting device having arresting fingers displaceable in an X axial direction extending perpendicular to a bending place for positioning a workpiece on a first bending tool for a bending operation between the first bending tool and a second bending tool displaceable relative thereto, and the arresting device has a carriage module which is displaceable in a linear guide arrangement in a Z axial direction extending parallel with the bending plane and a support plane, and the carriage module has a finger carrier providing a displaceable mounting for the arresting finger, which finger carrier can be displaced in a guide track of the carriage module in an R axial direction extending perpendicular to the support plane relative to the carriage module by a drive of a first drive arrangement, wherein the arresting fingers with an arresting surface are displaced in the X axial direction by a distance extending beyond a predefined stop-end position opposite the feeding direction of the workpiece into a stop-start position, after which the workpiece is moved by the workpiece handling device in the feeding direction of the workpiece in the direction of the stop-end position with a workpiece support surface lying against the arresting surfaces of the arresting fingers, and using stop-impulse signals of the first and the other arresting device and position data of the first and the other arresting device detected cyclically during the rest of the operation of moving the workpiece into the stop-end position, a workpiece incorrect position is corrected by regulating the path of the workpiece handling device in accordance with a regulating algorithm stored in the control device, and a drive on a second drive arrangement of the arresting finger for displacing the arresting finger relative to the finger carrier in the form of a servomotor activated by a measuring and controlling circuit of the control device is activated during the displacement of the arresting finger with the workpiece from the stop-start position into the stop-end position and the return of the arresting finger into the stop-start position, and wherein the arresting finger is actively displaced by the second drive arrangement in the direction of the stop-end position during the arresting operation, and a displacement speed of the arresting finger is lower than a speed at which the workpiece is fed.

2. The method according to claim 1, wherein the stop-impulse signal is generated as a position signal by the measuring and controlling circuit when a change in the position of the arresting finger from the stop-start position occurs due to the process of arresting the workpiece on the arresting finger.

3. The method according to claim 1, wherein the stop-impulse signal is generated as a load signal by the measuring and controlling circuit when a change in the power of a predefined motor power of the drive of the second drive arrangement of the arresting finger occurs due to the arresting operation.

4. The method according to claim 1, wherein activation of the second drive arrangement of the arresting finger is regulated in terms of speed and/or power and/or force and/or torque as a function of system and workpiece parameters stored in the control device.

5. The method according to claim 4, wherein a displacement resistance of the second drive arrangement of the arresting finger opposing the arresting movement can be regulated using the system and workpiece parameters.

6. The method according to claim 1, wherein a displacement resistance of the second drive arrangement of the arresting finger opposing the arresting movement is achieved by regulating the driving power of the drive of the second drive arrangement of the arresting finger.

7. The method according to claim 2, wherein the stop-impulse signals determined by the measuring and controlling circuit of the control device are used as control parameters for activating the workpiece handling device.

8. A method of operating a production device comprising at least one bending press and a workpiece handling device and having a central control device and a workpiece positioning device with a first arresting device and at least one other arresting device having arresting fingers displaceable in an X axial direction extending perpendicular to a bending place for positioning a workpiece on a first bending tool for a bending operation between the first bending tool and a second bending tool displaceable relative thereto, and the arresting device has a carriage module which is displaceable in a linear guide arrangement in a Z axial direction extending parallel with the bending plane and a support plane, and the carriage module has a finger carrier providing a displaceable mounting for the arresting finger, which finger carrier can be displaced in a guide track of the carriage module in an R axial direction extending perpendicular to the support plane relative to the carriage module by a drive of a first drive arrangement, wherein the arresting fingers with an arresting surface are displaced in the X axial direction by a distance extending beyond a predefined stop-end position opposite the feeding direction of the workpiece into a stop-start position, after which the workpiece is moved by the workpiece handling device in the feeding direction of the workpiece in the direction of the stop-end position with a workpiece support surface lying against the arresting surfaces of the arresting fingers, and using stop-impulse signals of the first and the other arresting device and position data of the first and the other arresting device detected cyclically during the rest of the operation of moving the workpiece into the stop-end position, a workpiece incorrect position is corrected by regulating the path of the workpiece handling device in accordance with a regulating algorithm stored in the control device, and a drive on a second drive arrangement of the arresting finger for displacing the arresting finger relative to the finger carrier in the form of a servomotor activated by a measuring and controlling circuit of the control device is activated during the displacement of the arresting finger with the workpiece from the stop-start position into the stop-end position and the return of the arresting finger into the stop-start position, and wherein an approach speed of the arresting finger is reduced in an area approaching the stop-start position.

9. The method according to claim 8, wherein the displacement force generated in the area approaching the stop-start position is less than or equal to 150 N.

10. A method of operating a production device comprising at least one bending press and a workpiece handling device and having a central control device and a workpiece positioning device with a first arresting device and at least one other arresting device having arresting fingers displaceable in an X axial direction extending perpendicular to a bending place for positioning a workpiece on a first bending tool for a bending operation between the first bending tool and a second bending tool displaceable relative thereto, and the arresting device has a carriage module which is displaceable in a linear guide arrangement in a Z axial direction extending parallel with the bending plane and a support plane, and the carriage module has a finger carrier providing a displaceable mounting for the arresting finger, which finger carrier can be displaced in a guide track of the carriage module in an R axial direction extending perpendicular to the support plane relative to the carriage module by a drive of a first drive arrangement, wherein the arresting fingers with an arresting surface are displaced in the X axial direction by a distance extending beyond a predefined stop-end position opposite the feeding direction of the workpiece into a stop-start position, after which the workpiece is moved by the workpiece handling device in the feeding direction of the workpiece in the direction of the stop-end position with a workpiece support surface lying against the arresting surfaces of the arresting fingers, and using stop-impulse signals of the first and the other arresting device and position data of the first and the other arresting device detected cyclically during the rest of the operation of moving the workpiece into the stop-end position, a workpiece incorrect position is corrected by regulating the path of the workpiece handling device in accordance with a regulating algorithm stored in the control device, and a drive on a second drive arrangement of the arresting finger for displacing the arresting finger relative to the finger carrier in the form of a servomotor activated by a measuring and controlling circuit of the control device is activated during the displacement of the arresting finger with the workpiece from the stop-start position into the stop-end position and the return of the arresting finger into the stop-start position, wherein the stop-impulse signal is generated as a position signal by the measuring and controlling circuit when a change in the position of the arresting finger from the stop-start position occurs due to the process of arresting the workpiece on the arresting finger, wherein the stop-impulse signals determined by the measuring and controlling circuit of the control device are used as control parameters for activating the workpiece handling device, and wherein a displacement force applied by the drive of the arresting finger is reduced in the area approaching the stop-start position.

11. The method according to claim 10, wherein the area approaching the stop-start position is equal to/less than 50 mm.

* * * * *